US009557127B2

(12) United States Patent
Macy

(10) Patent No.: US 9,557,127 B2
(45) **Date of Patent: *Jan. 31, 2017**

(54) DRUM MAGAZINE FOR PROJECTILES

(71) Applicant: Omar Alonso Macy, Gilroy, CA (US)

(72) Inventor: Omar Alonso Macy, Gilroy, CA (US)

(73) Assignee: Real Action Paintball (RAP4), Inc., Gilroy, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/469,291

(22) Filed: Aug. 26, 2014

(65) Prior Publication Data

US 2015/0040748 A1 Feb. 12, 2015

Related U.S. Application Data

(63) Continuation of application No. 13/786,280, filed on Mar. 5, 2013, now Pat. No. 8,839,706.

(51) Int. Cl.

| | |
|---|---|
| ***F41A 9/73*** | (2006.01) |
| ***F41B 11/50*** | (2013.01) |
| ***F41B 11/54*** | (2013.01) |
| ***F42B 6/10*** | (2006.01) |
| *F41B 11/55* | (2013.01) |

(52) U.S. Cl.

CPC ..... *F41A 9/73* (2013.01); *F41B 11/50* (2013.01); *F41B 11/54* (2013.01); *F42B 6/10* (2013.01); *F41B 11/55* (2013.01)

(58) Field of Classification Search

CPC ..... F41B 11/50; F41B 11/54; F41B 11/55
USPC ..... 89/33.02, 33.17; 124/45, 51.1
See application file for complete search history.

(56) References Cited

U.S. PATENT DOCUMENTS

| | | | | |
|---|---|---|---|---|
| 3,996,916 | A * | 12/1976 | Koehn et al. | 124/72 |
| 4,658,700 | A * | 4/1987 | Sullivan | 89/33.02 |
| 6,109,252 | A * | 8/2000 | Stevens | 124/51.1 |
| 6,428,384 | B1 * | 8/2002 | Su | 446/473 |
| 8,261,665 | B1 * | 9/2012 | Walsh | 102/498 |
| 8,839,706 | B1 * | 9/2014 | Macy | 89/33.02 |
| 2004/0079352 | A1 * | 4/2004 | Piccini | 124/49 |
| 2006/0081233 | A1 * | 4/2006 | Andresen | 124/51.1 |
| 2006/0283431 | A1 * | 12/2006 | Lee et al. | 124/41.1 |
| 2007/0256676 | A1 * | 11/2007 | Orvis et al. | 124/31 |
| 2011/0011386 | A1 * | 1/2011 | Tran | 124/51.1 |
| 2011/0253119 | A1 * | 10/2011 | Cho | 124/41.1 |
| 2012/0037138 | A1 * | 2/2012 | Huebl | 124/56 |

*Primary Examiner* — Bret Hayes
(74) *Attorney, Agent, or Firm* — James M. Wu; JW Law Group

(57) ABSTRACT

A projectile launcher includes a receiver and a dual cylindrical-shaped magazine ("DCM") wherein the receiver contains a propelling mechanism and an ammunition receiving port. The propelling mechanism is used for launching a projectile. The ammunition receiving port, which may be situated at bottom of the receiver, is able to receive projectiles. It should be noted that the projectile launcher can also be a gun or firearm. The DCM includes two canisters and an ammunition supply port which is situated between the two canisters. The DCM carries multiple projectiles in such a way that a first portion of projectiles moves toward the receiver against gravity for supplying projectiles from the ammunition supply port to the ammunition receiving port while a second portion of projectiles move in a direction parallel to the receiver for replenishing projectiles from the second portion of projectiles to the first portion of projectiles.

20 Claims, 13 Drawing Sheets

DRUM MAGAZINE FOR PROJECTILES

PRIORITY

This application is a divisional application of U.S. patent application Ser. No. 13/786,280, filed on Mar. 5, 2013 in the name of the same inventor and entitled "Drum Magazine for Projectiles," hereby incorporated into the present application by reference.

FIELD

The present invention relates to projectile propelling systems or apparatus. More specifically, the present invention relates to ammunition magazines for firearms and paintball markers.

BACKGROUND

A conventional projectile propelling system, such as a firearm or a paintball marker, is able to fire or launch ammunition continuously as long as the ammunition is available. Ammunition, for example, can be bullet for hand guns or paintballs for a paintball guns. To enhance firing power, a type of projectile propelling system employs a magazine which houses ammunition. A conventional magazine is a special container loaded with ammunition in such a way that, when the magazine is attached to a firearm, the ammunition in the magazine can be sequentially loaded and locked into a firing chamber by the loading mechanism of the firearm before ammunition can be launched.

For an automatic or semi-automatic firing apparatus, a projectile chamber is fired when a trigger is pulled. As soon as a projectile is fired, a retract mechanism of a firearm, for example, reloads the next projectile or bullet from the magazine for the subsequent firing. As the firing speed increases, more ammunition is needed to maintain the firing power. When ammunition in the magazine depletes, the projectile propelling system stops firing until the empty magazine is replaced with a fully loaded magazine.

To supply and provide sufficient amount of ammunition, users or operators usually carry multiple loaded magazines with a finite amount of ammunition such as bullets or paintballs. When ammunition inside a magazine depletes, the user replaces the magazine by removing the empty magazine from the projectile propelling system such as a gun and reattaching a fully loaded magazine before a projectile can be fired. Projectile propelling is interrupted or halted during the process of replacing a magazine. To minimize firing interruption from magazine replacement, reducing the frequency of magazine replacement as well as minimum effort of magazine replacement is essential.

A problem associated with a conventional ammunition magazine is that it holds a limited amount of ammunition or projectiles.

SUMMARY

One embodiment(s) of the present invention discloses a dual cylindrical-shaped magazine ("DCM") capable of being coupled to a projectile launcher or a firearm such as a gun for supplying ammunition. The projectile launcher, in one embodiment, includes a receiver having a magazine well configured to couple to the DCM. The receiver of the projectile launcher, in one example, contains a propelling mechanism and an ammunition receiving port, wherein the propelling mechanism is used for launching a projectile. The ammunition receiving port, which may be situated at the bottom of the receiver, is used to couple to the DCM for receiving projectiles and/or ammunition. It should be noted that the projectile launcher can also be a gun or firearm, and the DCM carries firearm ammunitions such as bullet.

The DCM, in one aspect, includes two drum-shaped canisters, a magazine extender, and an ammunition supply port, wherein the ammunition supply port is located on the magazine extender which is situated between the two canisters. The DCM carries multiple projectiles wherein the projectiles are organized in such a way that a first portion of projectiles moves toward the receiver against gravity for supplying ammunition from the ammunition supply port of DCM to receiving port of receiver and a second portion of projectiles move in a direction parallel to the receiver for replenishing projectiles to the first portion of projectiles.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
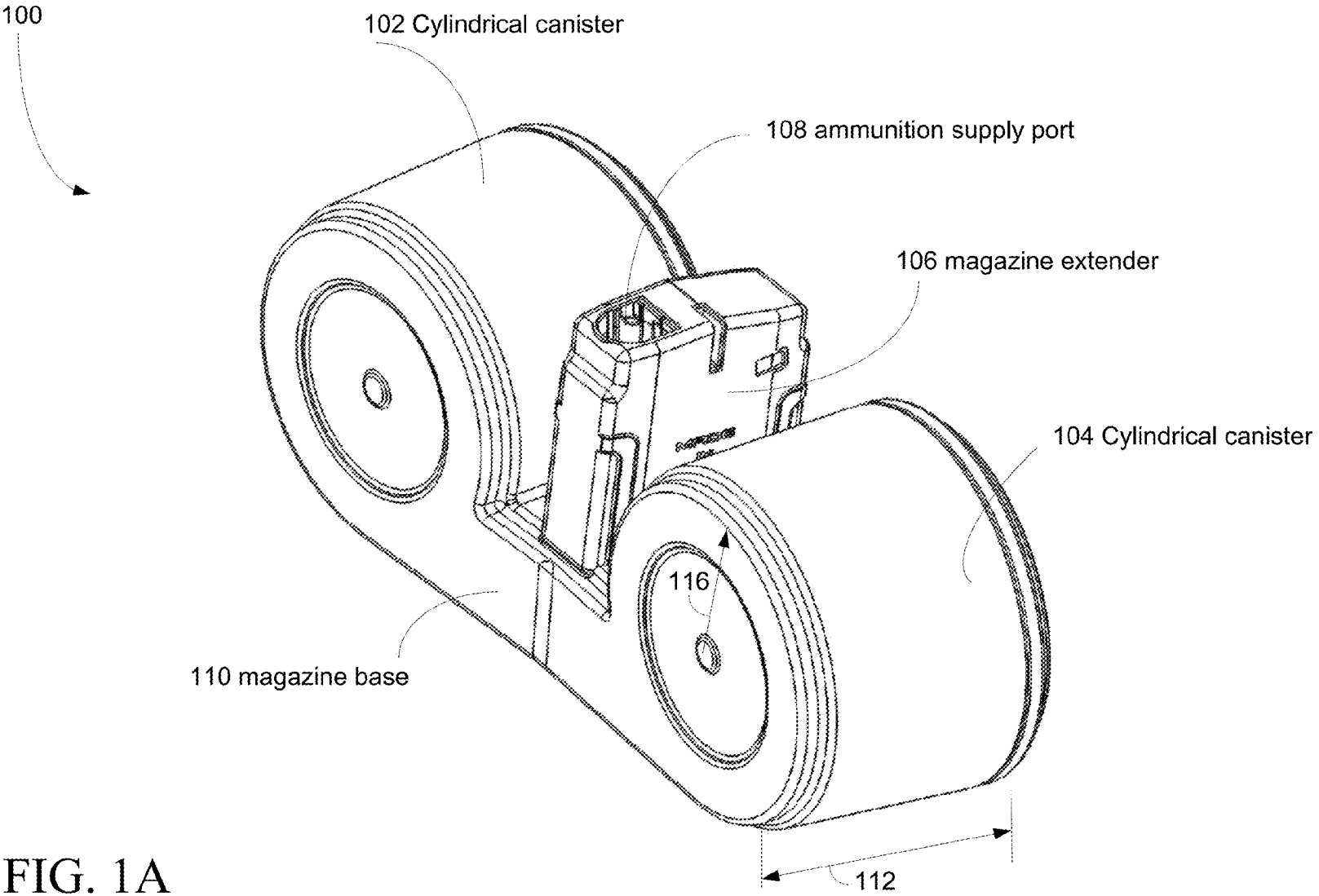
FIGS. 1A-1C are diagrams illustrating exemplary dual cylindrical-shaped magazine ("DCM") and a projectile launcher coupled to a DCM in accordance with one embodiment of the present invention.

Exemplary embodiment(s) of the present invention is described herein in the context of a method, system and apparatus of providing ammunition to a projectile propelling system ("PPS") via a dual-cylindrical magazine ("DCM").

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method. As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment(s) of the present application discloses a DCM which is capable of being used to supply projectiles to a launcher, PPS, or firearm. The projectile launcher or PPS, in one embodiment, includes a receiver configured to couple to the DCM. The receiver, in one example, contains a propelling mechanism and an ammunition receiving port, wherein the propelling mechanism is used for launching a projectile. The ammunition receiving port, which may be situated at the bottom of the receiver, is used to couple to the DCM for receiving projectiles and/or ammunition. It should be noted that PPS and/or projectile launchers are herein referred to as firearms, lethal weapon, non-lethal weapon, paintball markers, and/or tranquilizing guns.

The ammunition and/or projectile includes, but not limited to, bullet, paintball, delivery capsules, and the like. The paintballs usually include non-toxic, biodegradable, water soluble color substance wherein they leave colored marks upon breakage. A bullet, on the other hand, is generally made of cylindrical metal shell that can be expelled from a firearm, especially a rifle or handgun.

The DCM, in one aspect, includes two drum-shaped canisters, a magazine extender, and an ammunition supply port. The ammunition supply port is located on the magazine extender which is situated between the two canisters. The DCM carries multiple projectiles wherein the projectiles are organized in such a way that a first portion of projectiles moves toward the receiver traveling against gravity from ammunition supply port to receiving port of receiver. Second portion of projectiles moves in a direction parallel to the receiver and they are used to replenish projectiles to the first portion of projectiles.

FIG. 1A is a diagram illustrating an exemplary DCM 100 capable of carrying or housing multiple projectiles in accordance with one embodiment of the present invention. DCM 100 includes two cylindrical canisters 102-104, a magazine base 110, and a magazine extender 106. Magazine extender 106 further includes an ammunition supply port 108 which is used to couple to an ammunition receiving port located on a receiver (not shown in FIG. 1A) of a launcher or PPS. In one example, DCM 100 can hold projectiles from anywhere from 20 to 300 projectiles depending on the PPS used. It should be noted that the underlying concept of the exemplary embodiment(s) of the present invention would not change if one or more components (or units) were added to or removed from DCM 100.

Cylindrical canisters 102-104, in one embodiment, are structured in two cylinders with a height 112 and radius 116 capable of housing between 10 and 150 projectiles. Cylindrical canisters or canisters 102-104 can also be referred to as first canister and second canister, left canister and right canister, primary canister and secondary canister, or the like. Depending on the applications, height 112 and radius 116 can change based on specific requirements associated with PPS. The shape of cylindrical canisters 102-104 may also change to different shapes such as square or rectangular based on the applications.

Magazine base 110 is used to bridge canisters 102-104. In one aspect, magazine base 110 provides one or more ammunition channels for projectiles to move between canisters 102-104 or between canisters to extender 106. The projectiles, not shown in FIG. 1A, are able to travel from canister 102 to magazine extender 106 via magazine base 110. In an alternative example, projectiles can travel from one canister such as secondary canister 102 to another canister such as primary canister 104 for replenishing projectiles between canisters 102-104.

Magazine extender 106, in one embodiment, is structured or attached on top of magazine base 110 and provides ammunition to a receiver of PPS via ammunition supply port 108. Depending on the type of PPS used, different configuration of extender 106 may be selected for coupling to a magazine well of PPS. For example, each PPS or projectile launcher includes an ammunition receiving port which is generally located in a magazine well. While the ammunition receiving port of a PPS receives a projectile from ammunition supply port 108 when they are aligned, the magazine well is used to lock DCM to the PPS via magazine extender 106. It should be noted that the terms "PPS," "projectile launcher," "paintball marker," "paintball gun," and "projectile gun," are referring to a similar device and they can be used interchangeably.

Figure 1B:
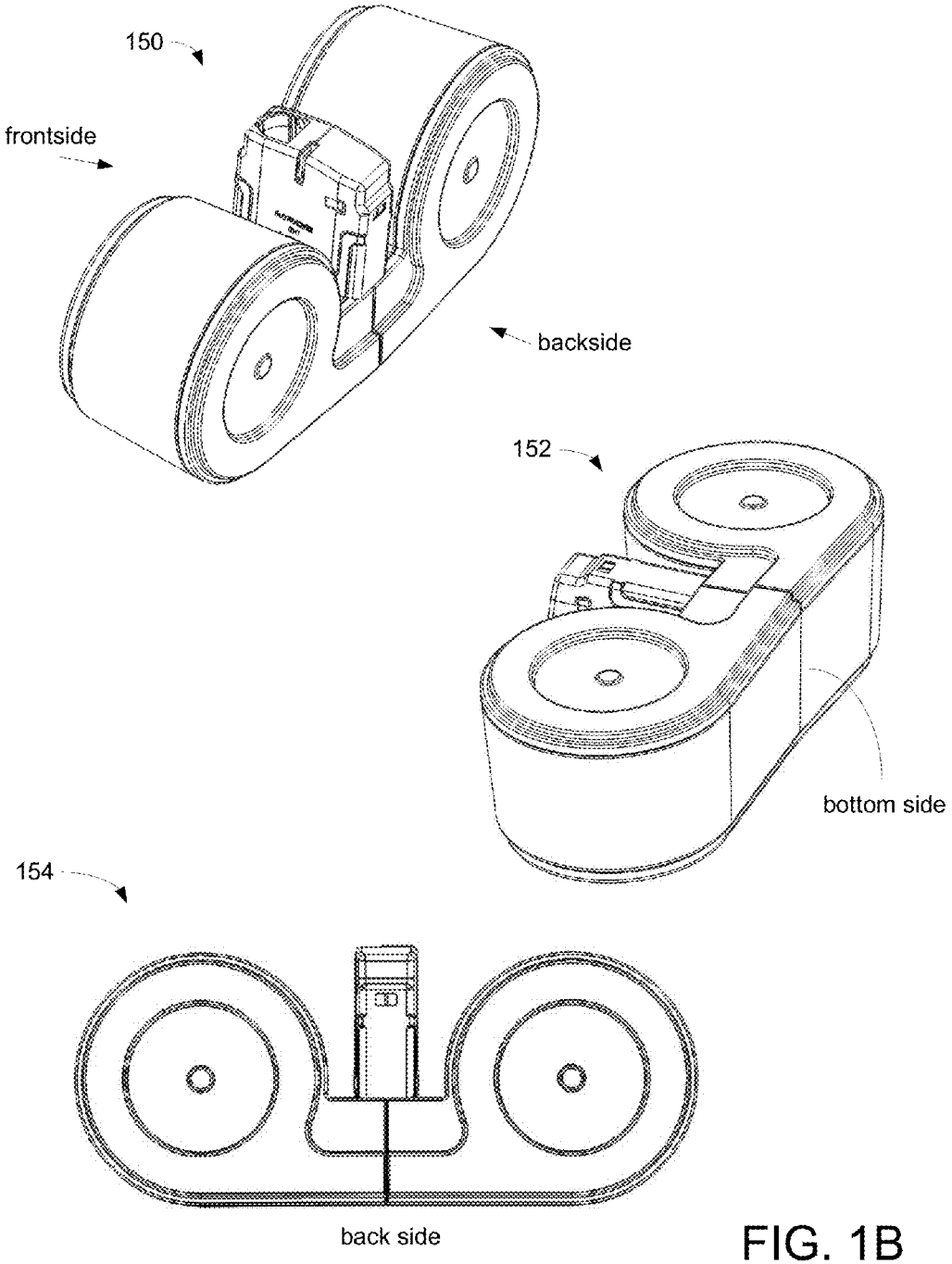

FIG. 1B illustrates diagrams 150-154 showing DCM 100 viewing from different angles in accordance with one embodiment of the present invention. Diagram 150, for example, is a 3D illustration showing a top backside view of DCM 100. Diagram 154 is a 2D illustration view from the backside of DCM 100. Diagram 152 is a 3D illustration showing a bottom backside view of DCM 100. Note that magazine extender, in one example, can be removed or attached based on the type of PPS used.

Figure 1C:
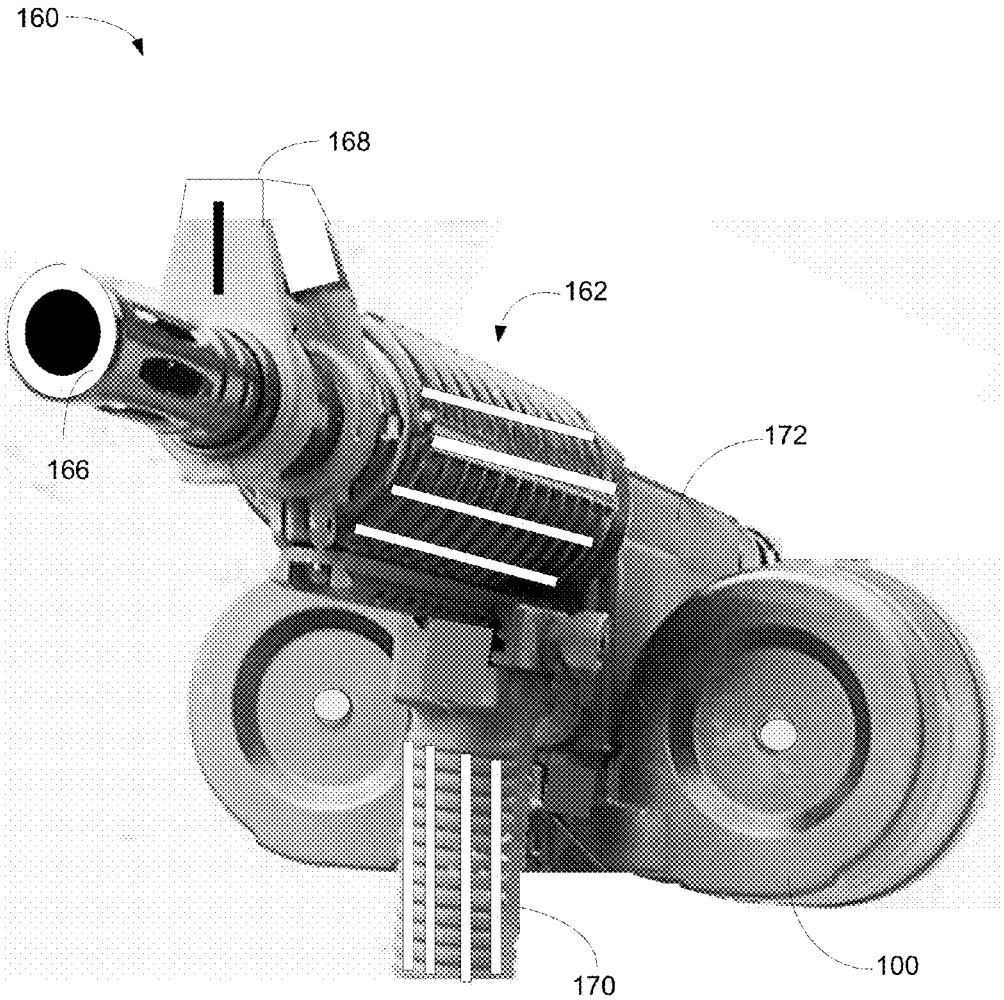

FIG. 1C is a diagram 160 illustrating an exemplary PPS capable of using DCM for ammunition supply in accordance with one embodiment of the present invention. Diagram 160 includes a PPS 162 and DCM 100 wherein PPS 162 includes a barrel 166, a front sight 168, a grip 170, and a receiver 172. Receiver 172 includes a magazine well used to couple to the extender of DCM 100 to receive ammunition from DCM 100. It should be noted that the underlying concept of the exemplary embodiment(s) of using DCM for ammunition supply would not change if one or more components (or units) were added to or removed from diagram 160.

Figure 2A:
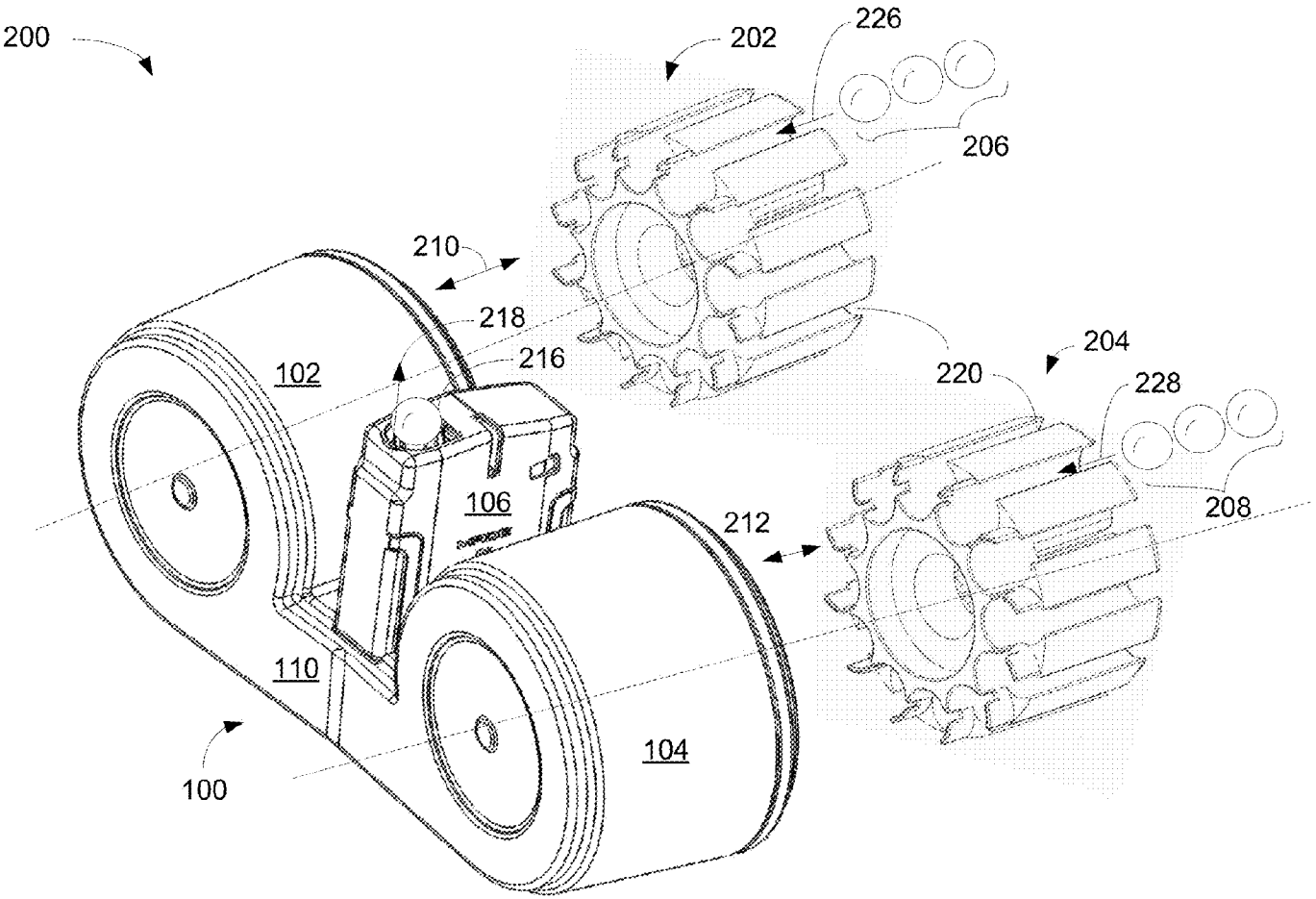
FIGS. 2A-C are three-dimensional ("3D") illustrations showing exemplary DCM including ammunition carriers in accordance with one embodiment of the present invention.

FIG. 2A is a 3D diagram 200 illustrating an exemplary DCM 100 including two ammunition carriers 202-204 in accordance with one embodiment of the present invention. To illustrate internal structure, ammunition carriers or carriers 202-204 have been moved out of canisters 102-104 as indicated by arrows 210-212. Carriers 202-204, in one aspect, can rotate inside of canister 102-104 for dispensing stored projectiles. Each carrier, in one embodiment, includes multiple ammunition chambers or chambers 220 wherein each chamber 220 can house or store from two (2) to ten (10) projectiles 206-208. In one aspect, projectiles 206-208 are paintballs and/or substance delivery capsules. It should be noted that the underlying concept of the exemplary embodiment(s) of the present invention would not change if one or more components (or units) were added to or removed from diagram 200.

During an operation, ammunition carriers 202-204 with fully loaded projectiles 206-208 in their chambers 220 rotate in a predefined direction to supply ammunition to a connected or coupled receiver. When carriers 202-204 rotate, projectiles such as paintballs 206-208 in chambers 220 are gently pushed or pressured in a first direction indicated by arrows 226-228. Upon exiting carriers 202-204 and entering extender 106 via ammunition base 110, projectiles such as projectile 216 moves in a second direction indicated by arrow 218. In one embodiment, the first direction indicated by arrows 226-228 and the second direction indicated by arrow 218 are approximately perpendicular with each other. It should be noted that carriers 202-204 can carry projectiles other than paintballs.

Figure 2B:
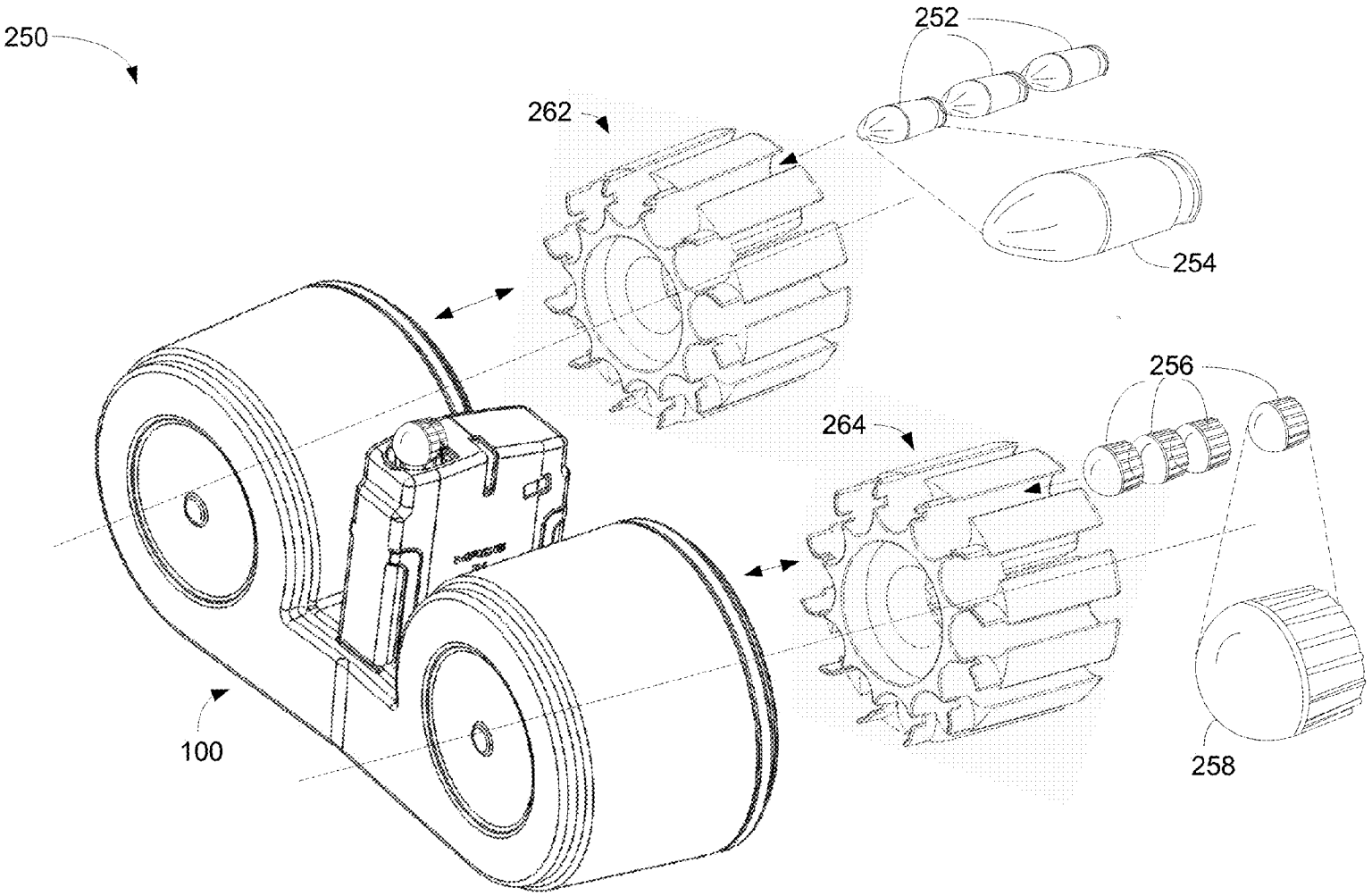

FIG. 2B is a 3D diagram 250 illustrating an exemplary DCM 100 including ammunition carriers 262-264 in accordance with one embodiment of the present invention. Diagram 250 is similar to diagram 200 as illustrated in FIG. 2A except that carriers 262-264 are configured to carry different types of ammunition. For example, carrier 262 is configured to carry or house bullets 252 which are used to supply firearm receiver(s) such as a gun. Note that bullet 254 is an enlarged view of bullet 252. Alternatively, carrier 264 is configured to carry paintballs or delivery capsules with fins 256. Delivery capsule 258 is an enlarged view of capsules 256 wherein the fins can provide distance and accuracy of the capsules. If fins of capsule 256 are design to spin after launch, delivery capsules 256, for example, should travel longer distance than projectiles without fins.

Figure 2C:
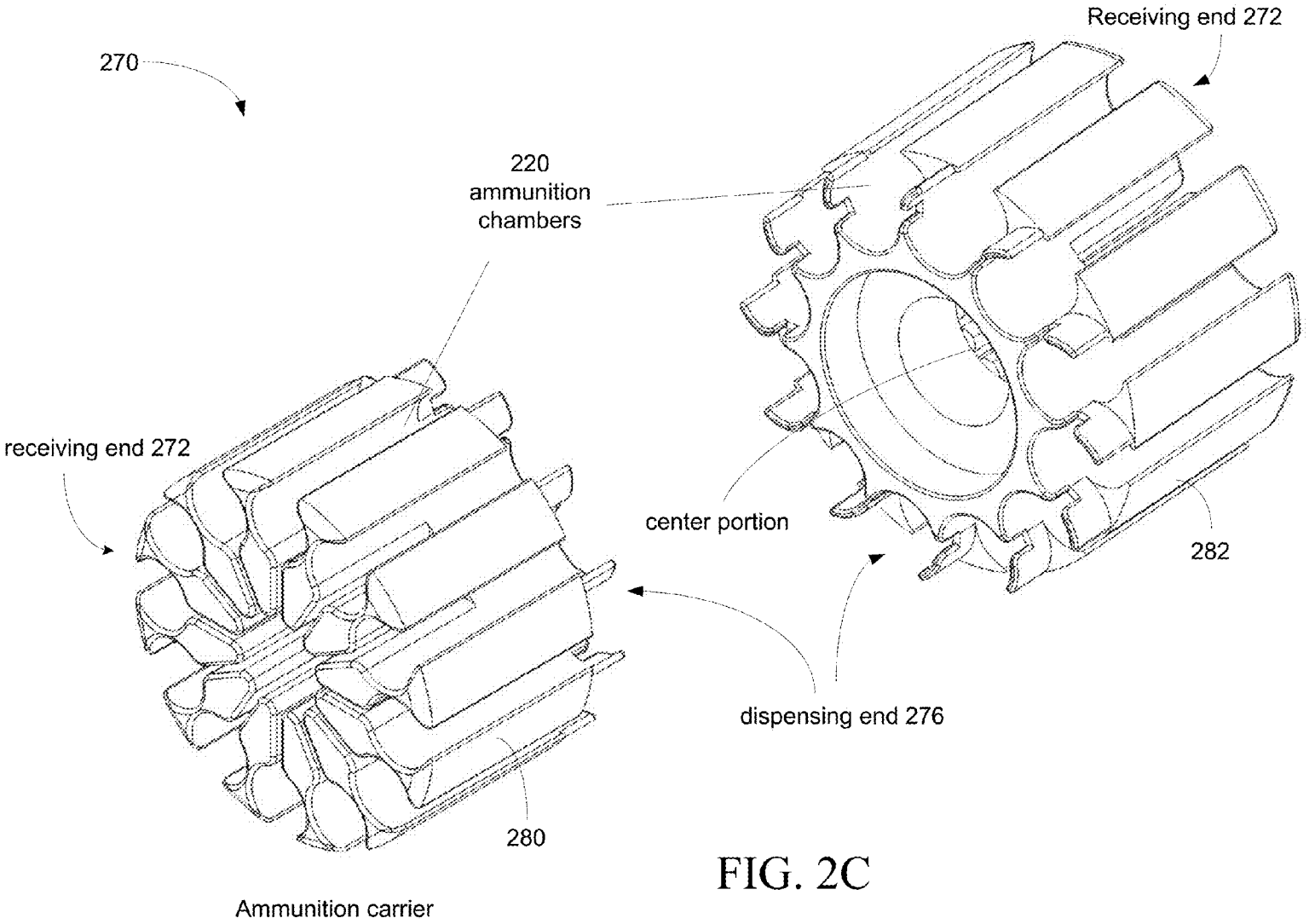

FIG. 2C is a 3D diagram 270 showing an ammunition carrier 280 configured to operate inside of a canister of DCM in accordance with one embodiment of the present invention. Ammunition carrier 270, in one embodiment, includes multiple ammunition chambers 220 wherein each ammunition chamber 220 includes a receiving end 272 and a dispensing end 276. In one aspect, each carrier can have from 6 chambers to 24 chambers depending on applications. It should be noted that carrier 282 is the same carrier as ammunition carrier 280 except that carrier 282 is viewed from dispensing end 276 instead of receiving end 272 as indicated by carrier 280.

Receiving end 276 of chamber 220 is used to load projectiles such as paintballs or bullets. Each chamber 220, for example, may be able to hold from 2 to 10 projectiles depending on the applications. After loading, the projectiles move from receiving end 272 to dispensing end 276 in the chamber. In one embodiment, a pressure pedal is employed to each chamber 220 for gently pushing the projectiles in a predefined direction. The pressure pedals may be installed in the center portion of carrier 280-282.

Figure 3:
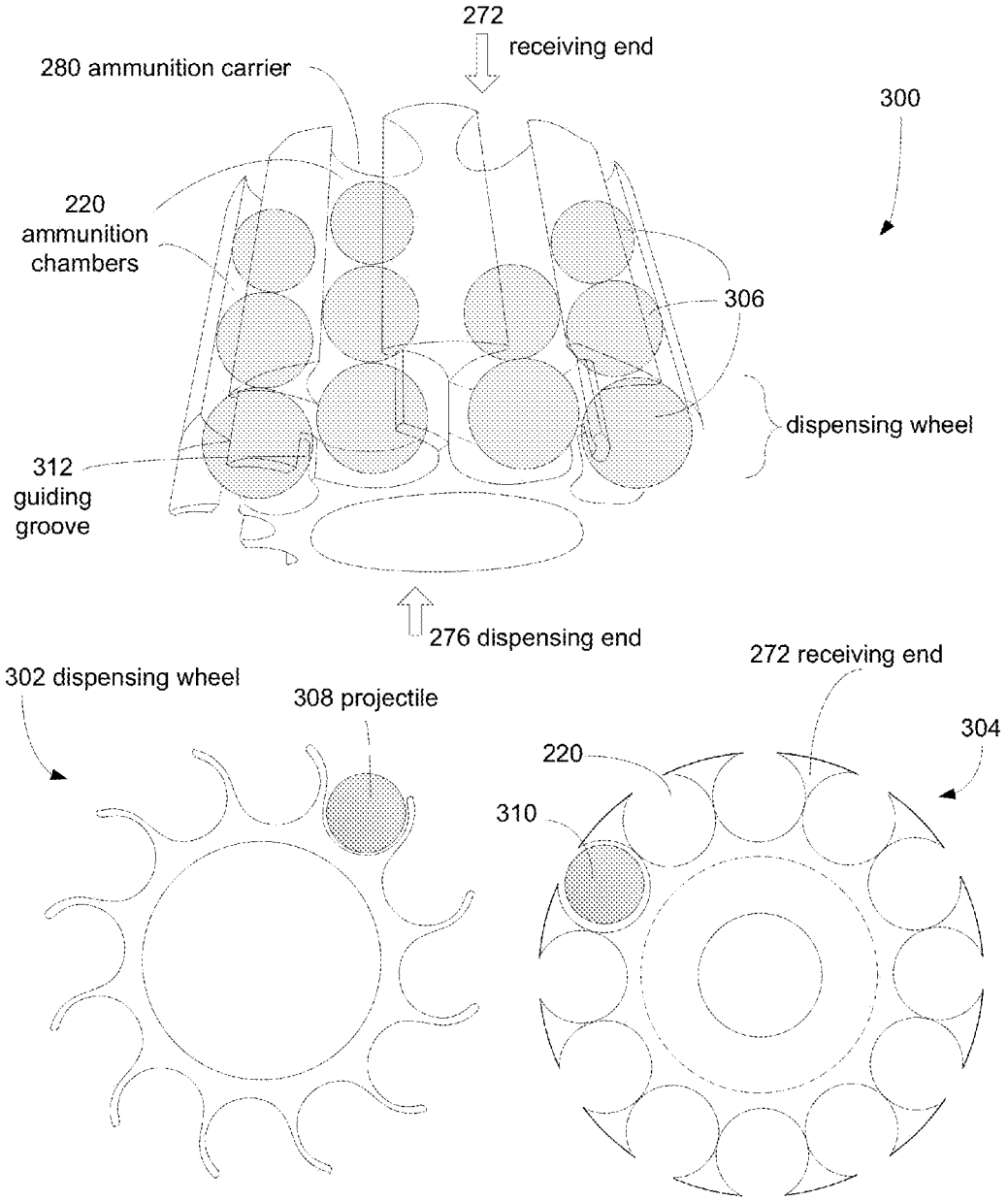
FIG. 3 includes diagrams illustrating ammunition carrier in accordance with one embodiment of the present invention.

FIG. 3 includes diagrams 300-304 illustrating ammunition carrier and dispensing wheel in accordance with one embodiment of the present invention. Diagram 300 illustrates an ammunition carrier 280 with an angled bottom-up view. Carrier 280, in one embodiment, includes twelve (12) chambers 220 wherein some chamber 220 are filled with two (2) or three (3) projectiles such as paintballs 306. In one aspect, carrier 280 includes receiving end 272 and dispensing end 276 wherein dispensing end 276 further includes a guiding groove 312. Guiding groove 312, in one example, is used to guide projectiles 306 to leave carrier 280 to an ammunition supply port (not shown in FIG. 3).

Diagram 302 illustrates a dispensing wheel, which is situated between carrier 280 and the canister of DCM. In one aspect, dispensing wheel can be fabricated together with carrier 280 as a single device as shown in diagram 300. A function of dispensing wheel is to dispense one projectile at a giving time. Depending on the applications, dispensing wheel is used to guide or force projectiles such as paintballs 308 to move in a guided direction.

Diagram 304 is a top view of carrier 280. The top end of carrier 280 is also receiving end 272. Diagram 304 illustrates a twelve-chamber carrier capable of carrying a range of projectiles anywhere from 36 to 120 projectiles such as paintballs 310. In one example, paintballs 310 can be loaded through the top end or receiving end of carrier 280 and subsequently can be dispensed at dispensing end 276.

Figure 4:
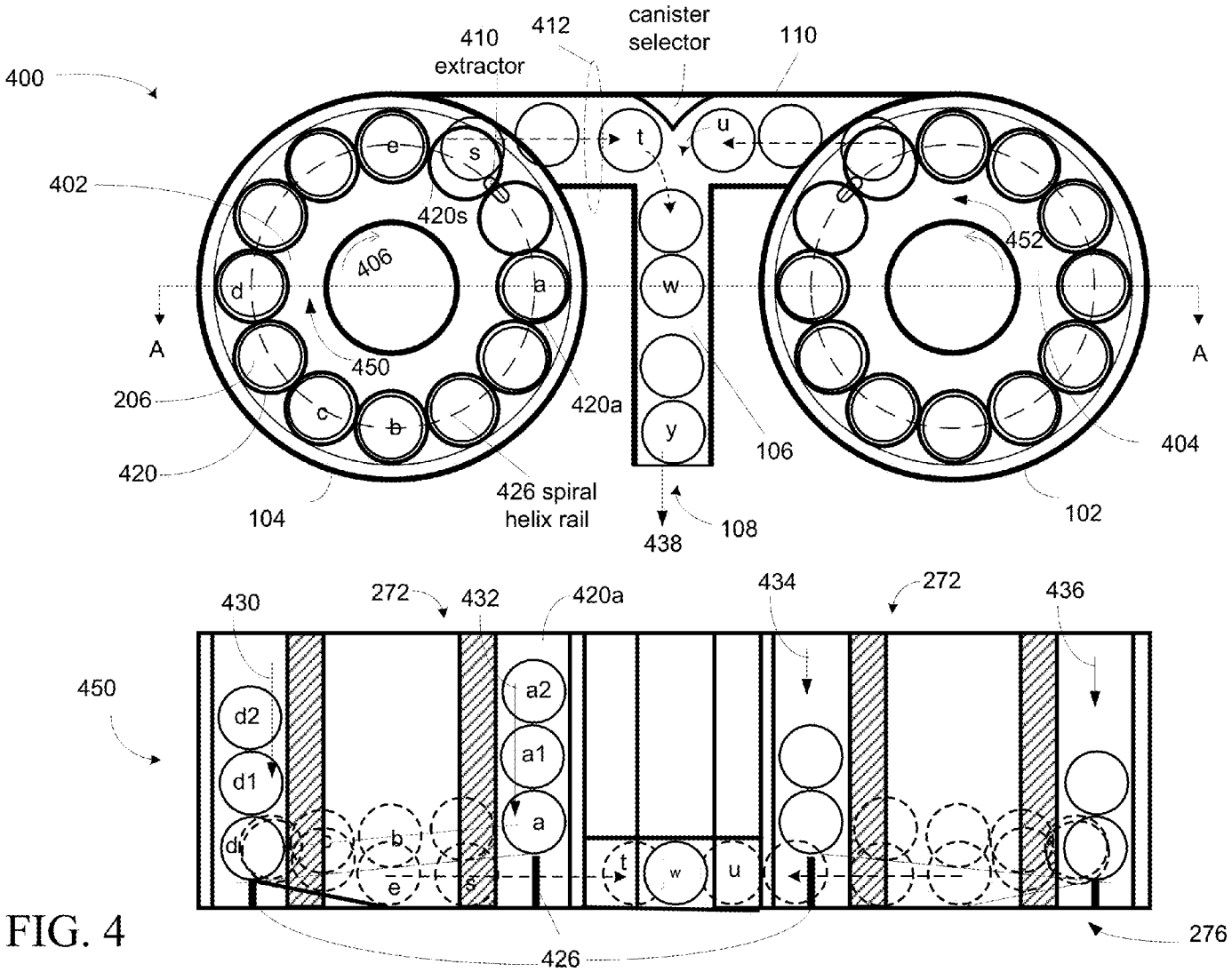
FIG. 4 illustrates diagrams showing projectiles movement within DCM in accordance with embodiments of the present invention.

FIG. 4 illustrates diagrams showing projectiles movement within DCM in accordance with embodiments of the present invention. Diagram 400 is a cut-away diagram illustrating a bottom portion of DCM. Diagram 400 includes two canisters 102-104, ammunition base 110, extender 106, and multiple projectiles 206 such as paintballs. Diagram 450 illustrates a cross-section view of an entire DCM cutting across A-A line shown in diagram 400. It should be noted that the underlying concept of the exemplary embodiment(s) of the present invention would not change if one or more components (or units) were added to or removed from diagram 400 or 450.

DCM is ammunition storage capable of storing or housing ammunition for a PPS or a firearm. DCM, in one embodiment, includes two canisters 102-104, base 110, extender 106, and ammunition supply port 108. Ammunition supply port 108 is placed or installed at extender 106 which is situated between two canisters 102-104. DCM, in one example, carries projectiles 206 in such a way that a first portion of projectiles moves toward a receiver against gravity for supplying projectiles while a second portion of projectiles move in a direction parallel to the receiver for replenishing projectiles 206 that depart from DCM.

The receiver, in one instance, contains a propelling mechanism for launching a projectile using, for example, compressed gas. The ammunition receiving port of receiver is configured to receive projectiles and is situated, for instance, at the bottom of the receiver. The receiver, in one example, is a paintball receiver containing a striker, a valve, and a launch chamber configured to launch a paintball. The receiver includes a top surface, a bottom surface, a front side, and a back side, wherein the top surface faces sky, the bottom surface faces ground, the front side launches projectile, and the back side faces user. Note that a projectile can be any types of substance delivery capsules such as paintballs, projectiles with fins, lethal delivery capsules, non-lethal delivery capsules, chemical delivery balls, and the like.

Two canisters 102-104 of DCM further include a left-side drum-shaped cylinder ("LDC") 402 and a right-side drum-shaped cylinder ("RDC") 404, wherein LDC and RDC are bridged by a magazine base 110. LDC 402 and RDC 404 are ammunition carriers which are similar to carriers 202-204 shown in FIG. 2A. Magazine extender or extender 106 is coupled to magazine base 110 and is coupled to ammunition well of a receiver upon alignment of supply port 108 and receiving port. Ammunition supply port 108 is coupled to the ammunition receiving port of receiver for channeling projectiles 206 traveling from canisters 102 or 104 to the receiver via base 110 and extender 106.

Each canister 102 or 104 of DCM includes a round-shaped ammunition carrier 402 or 404 able to rotate along its axis within the canister. Ammunition carrier 402 or 404 includes a range of six (6) to twenty (20) ammunition chambers 420 wherein each ammunition chamber or chamber 420 can hold a range of two (2) to ten (10) projectiles 206. The axes of chambers 420 are configured in parallel with the axis of ammunition carrier 402 or 404. Each of ammunition chamber 420 includes a loading opening 272 or for projectile entrance and a dispensing opening 276 for projectile departure. Note that loading opening 272 and dispensing opening 276 are the same as the receiving end and dispensing end, respectively.

DCM further includes rotating agitator(s) 406 and pressure pedals wherein the rotating agitator 406 coupled to ammunition carriers 402-404 is capable of spinning ammunition carriers 402-404 along their axes. In one embodiment, agitator or rotating mechanism 406 can be situated in the center of canister 102 or 104. Alternatively, agitator 406 may be installed in the middle of carrier 402 or 404. It should be noted that depending on the applications, carriers 402-404 may rotate in the same direction or in the different directions.

Each of the pressure pedals, in one embodiment, is gently coupled to an ammunition chamber and is configured to force the projectile or projectiles moving from loading opening 272 to dispensing opening 276 as indicated by arrows 430-436. DCM further includes a dispensing wheel (not shown in FIG. 4) and a ramp 426. The dispensing wheel is situated adjacent to dispensing end 276 of ammunition carrier 402 or 404 and is configured to dispense projectiles from dispensing openings 276 of ammunition chambers 420. In one aspect, dispensing wheel is part of carrier 402 or 404. Ramp 426, which is also known as spiral helix rail, is a guided path to guide projectiles from ammunition carrier 402 or 404 to ammunition supply port 108.

DCM also includes an extractor 410 and canister selector 416 wherein extractor 410 is installed at each canister 102 or 104 for extracting single projectile at a given time. For example, extractor 410 extracts one projectile from a canister and guides it to base 110 via a channel 412. Canister selector 416 is used to select where a projectile should be allowed to move onto extender 106 from channels 412. Note that base 110 includes at least two channels 412 for facilitating movement of projectiles from canisters 102-104 to extender 106.

Base 110, in one embodiment, includes two channels 412 wherein one is used to channel projectiles from carrier 402 to extender, while another is used to channel projectiles from carrier 404 to extender 106. Canister selector 416, in one example, switches between carriers 402-404 or two channels 412 allowing projectiles to enter extender 106 in an alternate manner. Note that canister selector 416 can be simple conventional alternate switch such as a Geneva drive or a sophisticated electronic switching device.

During operation, when carriers 402-404 are loaded with projectiles via receiving end 272, chambers 420 within carriers 402-404 are filled with projectiles such as paintballs. For example, chamber 420*a* is filled with paintballs a, a1, and a2. When carrier 402 rotates or agitates in a direction indicated by arrow 450, carrier 404, in one aspect, rotates in an opposite direction as indicated by arrow 452. When carrier rotates, paintballs such as paintballs a and a1 move in a direction 432, the bottom layer of paintballs travel in a direction indicated by arrow 450 as shown in diagram 400. When carrier 450 rotates, a portion of paintballs such as paintball a, b, c, d, e, and s moves along ram 426 in a rotating direction indicated by arrow 450. When paintball s engages with extractor 410, paintball s moves from carrier 420 to channel 412 in base 110. Canister selector 416 selects a paintball such as paintball t to move into extender 106. Note that paintball y is about to move out of supply port 108 in a direction indicated by arrow 438 to a receiver (not shown in FIG. 4). Note that direction 432 and direction 438 are approximately perpendicular with each other.

When carriers 402 rotates in a predefined rate based on PPS used, paintballs 206 at exit end 276 of chambers 420 are ready to be dispensed from chambers 420 to ammunition extender 106. Paintballs in extender 106 such as paintballs (i.e., w, y, . . . ) move against gravity toward ammunition supply port 108 while paintballs (i.e., a1 and a2) move in a direction 432 approximately parallel with the receiver.

Figure 5:
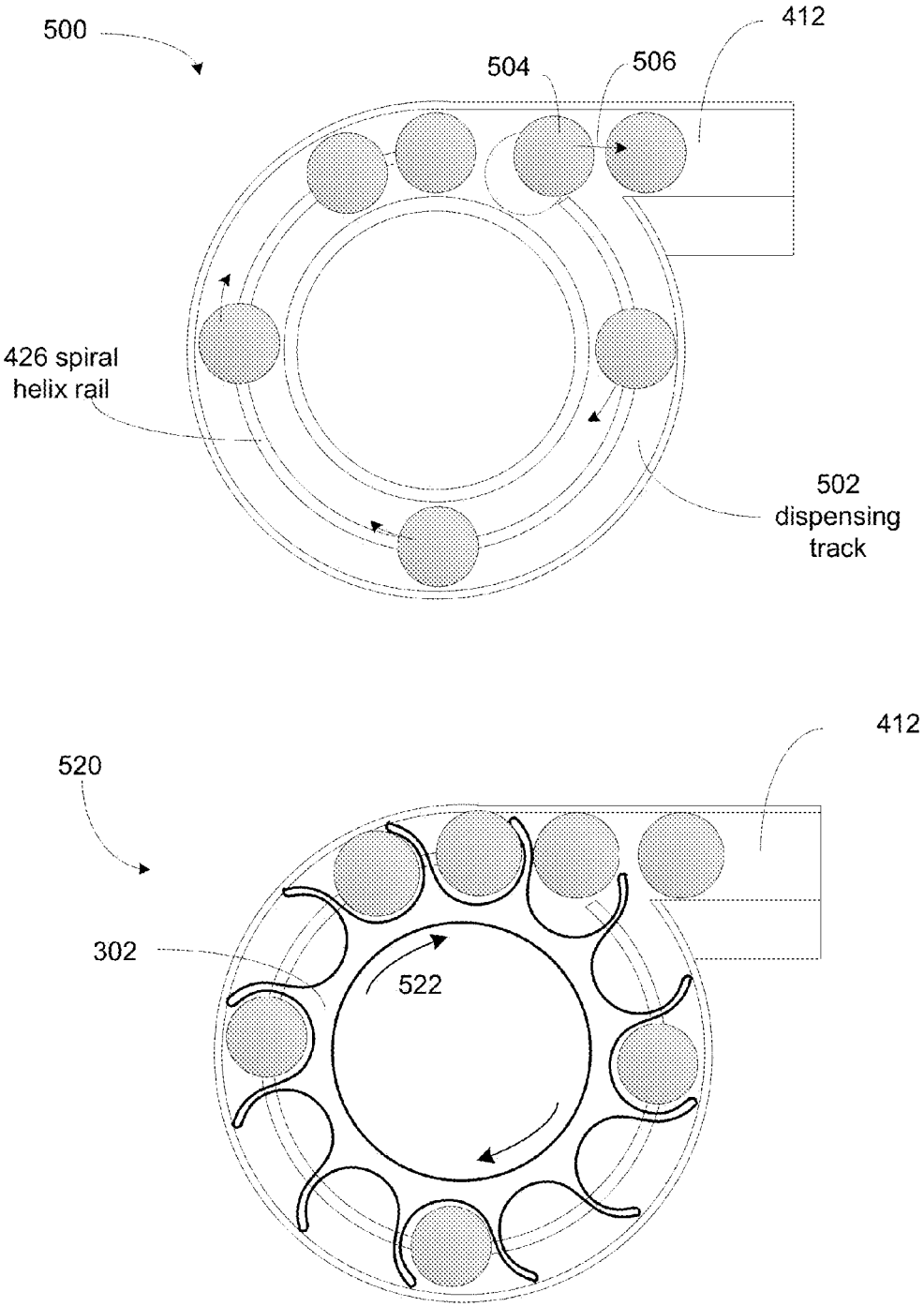
FIG. 5 is an exemplary diagram illustrating ramp, dispensing wheel, and dispensing track in an ammunition carrier in accordance with one embodiment of the present invention.

FIG. 5 is an exemplary diagram illustrating a ramp, a dispensing wheel, and/or a dispensing track in DCM in accordance with one embodiment of the present invention. Diagram 500 illustrates a canister having a dispensing track 502 hosting ramp or spiral helix rail 426. One end of rail or ramp 426, which is raised from track 502, can be used as an extractor which guides paintball 504 to exit the carrier as indicated by arrow 506. Diagram 520 illustrates similar components as diagram 500 except that a dispensing wheel 302 is added. It should be noted that the underlying concept of the exemplary embodiment(s) of the present invention would not change if one or more components (or units) were added to or removed from diagrams 500 and 520.

Figure 6:
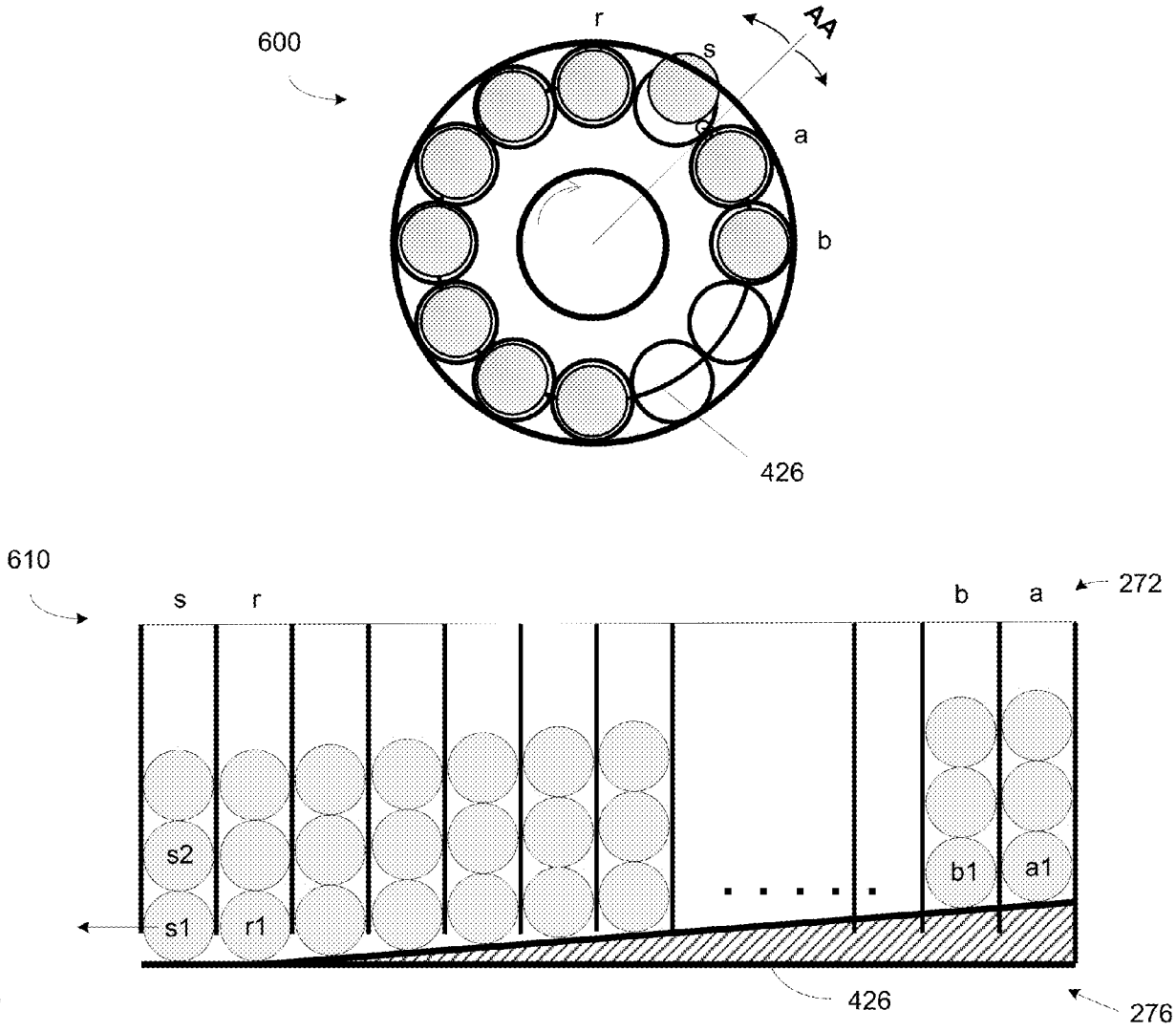
FIG. 6 illustrates an exemplary ammunition carrier including a loading end and a dispensing end in accordance with one embodiment of the invention.

FIG. 6 illustrates an exemplary ammunition carrier including a loading end and a dispensing end in accordance with one embodiment of the invention. Diagram 600 illustrates a carrier filled with paintballs coupled with a ramp 426. Diagram 610 is a cross-section view cut-open along a vertical A-A line of a canister shown in diagram 600. Diagram 610 includes multiple chambers wherein each chamber stores three paintballs. Ramp or rail 426 is structured with a slop that guides the movement of paintballs located at the bottom row of carrier.

Figures 7A, 7B:
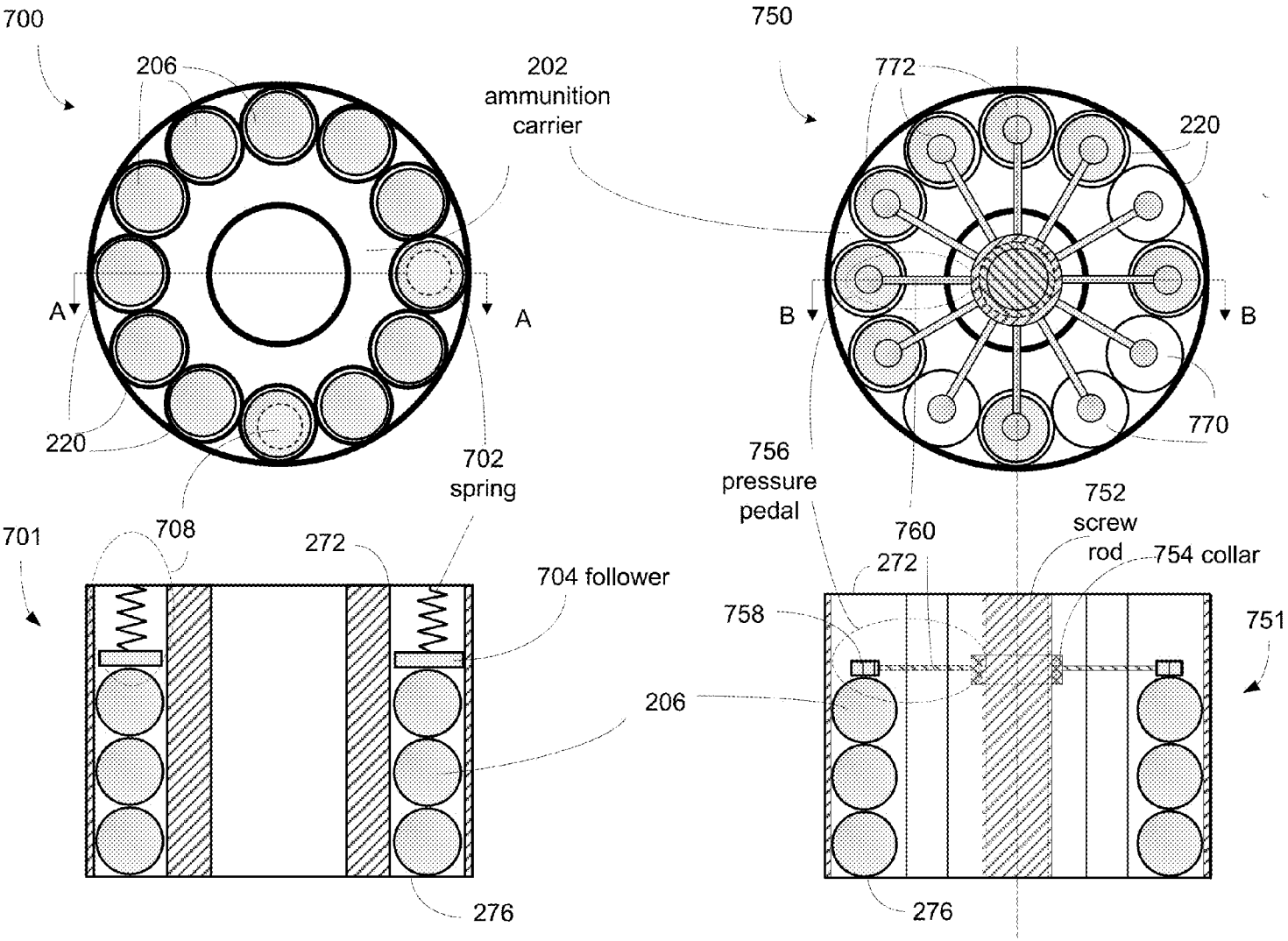
FIGS. 7A-B are exemplary diagrams showing pressure pedals used with ammunition carrier for retraining projectile movement in accordance with one embodiment of the present invention.

FIG. 7A is an exemplary diagram 700 showing pressure pedals 708 used with ammunition carrier 202 for restraining projectile movement in accordance with one embodiment of the present invention. Diagram 701 is a cross-section diagram showing a cross-section of carrier 20 cutting along the A-A line shown in diagram 700. Carrier 202, in one example, includes twelve (12) chambers wherein each chamber can hold up to three projectiles or paintballs 206. In one embodiment, a set of pressure pedals 708 is used to restrain movement of paintballs 206 once paintballs 206 are loaded into chambers 220. It should be noted that the underlying concept of the exemplary embodiment(s) of the present invention would not change if one or more components (or units) were added to or removed from diagram 700.

The set of pressure pedals 708, in one embodiment, includes twelve (12) pressure pedals wherein each of pressure pedal 708 is dedicated to a chamber. Each of pressure pedals 708, in one embodiment, includes a spring 702 and a follower 704. After chamber 220 is loaded with paintballs 206, a pressure pedal 708 is mounted from receiving end 272 whereby pressure pedal 708 gently pushes or follows paintballs 206 from receiving end 272 to dispensing end 276.

FIG. 7B is a diagram 750 illustrating an alternative configuration of pressure pedals 756 used with ammunition carrier 202 for retraining projectile movement in accordance with one embodiment of the present invention. Diagram 751 is a cross-section diagram showing a cross-section of carrier 202 cutting along a B-B line shown in diagram 750. Carrier 202 includes twelve (12) chambers wherein each chamber can hold up to three projectiles or paintballs 206. In one embodiment, a set of pressure pedals 756 is used to restrain movement of paintballs 206 once paintballs 206 are loaded into chambers 220.

The set of pressure pedals 756, in one embodiment, includes twelve (12) pressure pedals wherein each of pressure pedal 756 is dedicated to a chamber. In one embodiment, each of pressure pedals 756 includes a pad 758 and rod 760. After chamber 220 is loaded with paintballs 206, a pressure pedal 756 is mounted from receiving end 272 whereby pressure pedal 756 is used to gently push paintballs 206 from receiving end 272 to dispensing end 276. In one aspect, the set of pressure pedals 756 is controlled by a screw rod 752 with a collar 754 located in the middle of carrier 202. With a predefined dispensing rate of paintballs exiting from carrier 202, pressure pedals 756 is calibrated in accordance with the rotation of screw rod 752 to provide adequate pressure on paintballs 206 as carrier 202 rotates.

Figure 8:
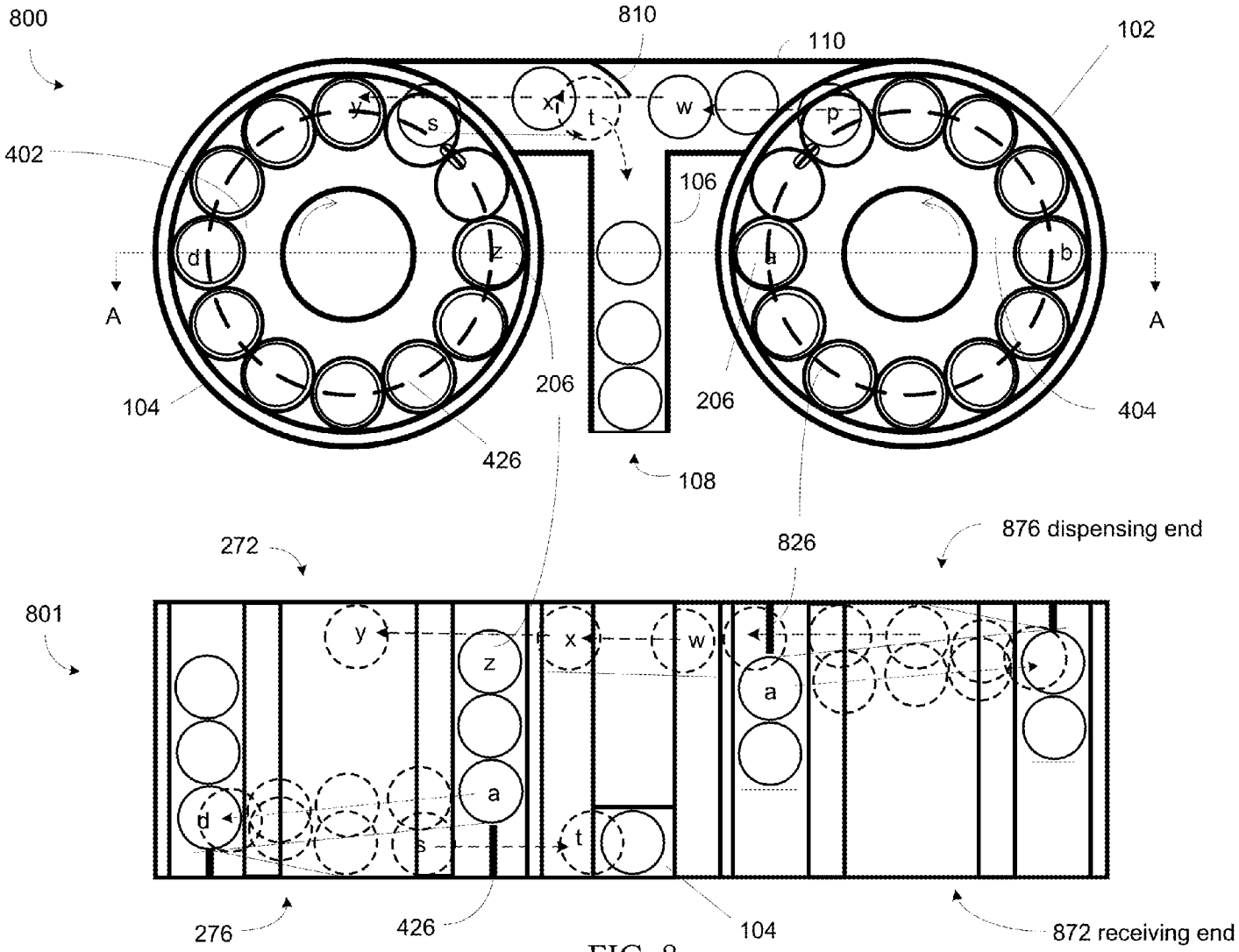
FIG. 8 illustrates diagrams showing projectiles that are replenished by a reserve canister in DCM in accordance with embodiments of the present invention.

FIG. 8 illustrates diagrams 800-801 showing projectiles that are replenished by a reserve canister in DCM in accordance with embodiments of the present invention. Diagram 800, which is similar to diagram 400 shown in FIG. 4, is a cross-section diagram illustrating a bottom portion of DCM. Diagram 800 includes two canisters 102-104, ammunition base 110, extender 106, and multiple projectiles 206 such as paintballs. Diagram 801 illustrates a cross-section view of DCM cutting along an A-A line shown in diagram 800. It should be noted that the underlying concept of the exemplary embodiment(s) of the present invention would not change if one or more components (or units) were added to or removed from diagram 800.

Canister 102, in this embodiment, is used as a secondary or reserve storage for primary or dispensing canister 104. In one example, base 110 includes a replenishing channel which is used for replenishing projectiles from the reserve canister such as canister 102 to the dispensing canister such as canister 104. Canister 102, in one aspect, includes receiving end 872 which is opposite from receiving end 272 of canister 104. Similarly, canister 102 also includes a dispensing end 876 which is opposite from dispensing end 276 of canister 104. Base 110 includes a dispensing channel having a guide 810 used to guide paintball from base 110 to extender 106. The replenishing channel of base 110 is used to guide paintballs from canister 102 to canister 104 via an independent channel.

Figure 9:
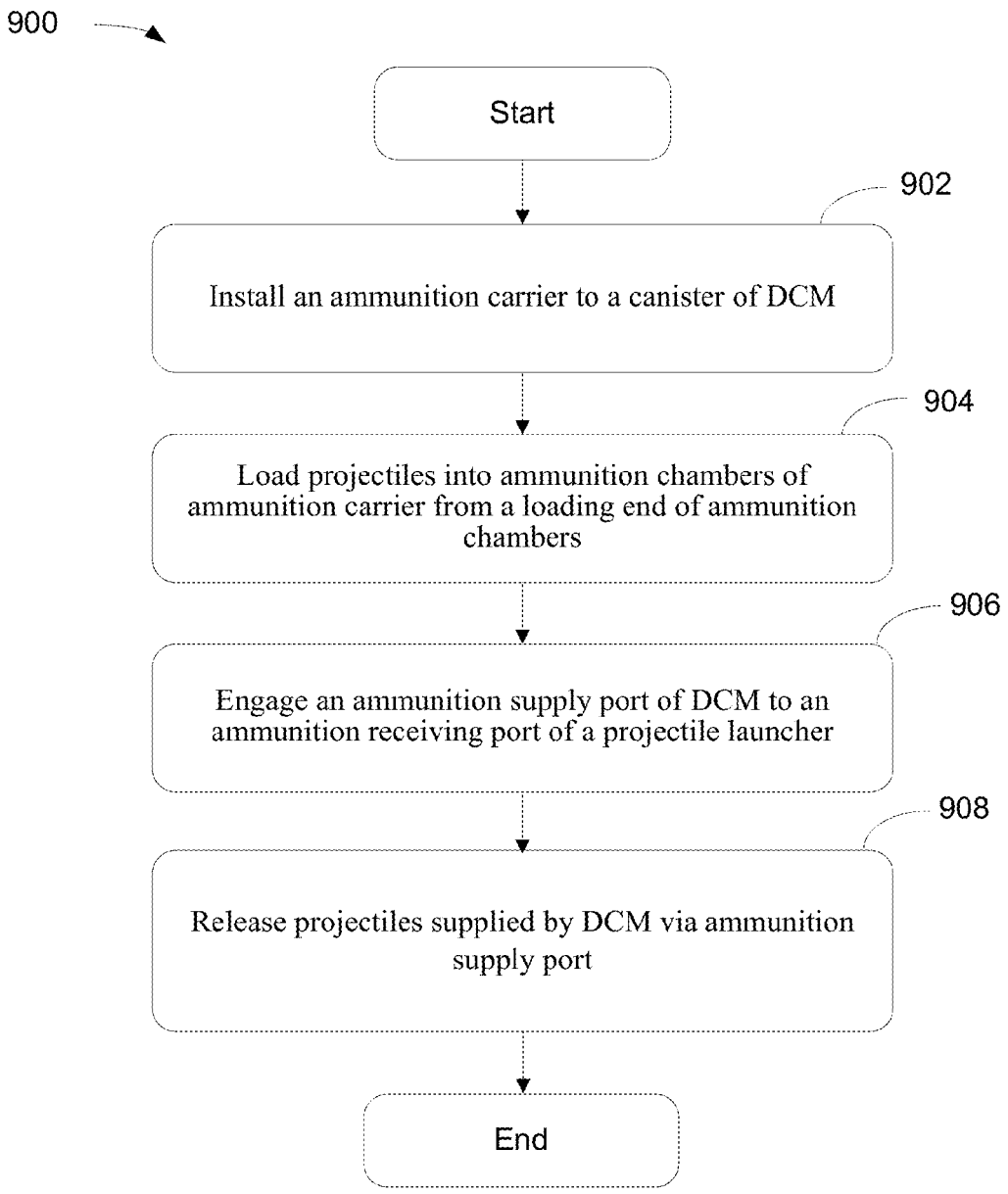
FIG. 9 is a flowchart illustrating a process of loading and launching projectiles using DCM in accordance with one embodiment of the present invention.

FIG. 9 is a flowchart 900 illustrating a process of loading and launching projectiles using DCM in accordance with one embodiment of the present invention. At block 902, a process able to supply large volume of ammunition to a projectile launcher installs a first ammunition carrier having ammunition chambers in a first canister of a DCM and a second ammunition carrier in a second canister of the DCM. After loading projectiles such as paintball into loading openings of the ammunition chambers and setting pressure pedals over the chambers to guide the projectiles moving in a predefined direction, an ammunition supply port of the DCM is engaged with an ammunition receiving port in a projectile launcher to receive ammunition.

Upon releasing projectiles queued in a substantially vertical direction in a magazine extender through the ammunition supply port, a portion of projectiles in the chambers moves in a horizontal direction parallel with the receiver for replenishing released projectiles. Note that the vertical direction can be an upward direction against gravity. The process is able to apply a pressure to the projectiles in the ammunition chambers by pressure pedals.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. An ammunition storage comprising:

a dual cylindrical-shaped magazine ("DCM") containing an ammunition supply port situated between two canisters, wherein the DCM carries a plurality of paintballs in such a way that a first portion of paintballs moves in a direction against gravity for supplying paintballs to an ammunition receiving port of a receiver and a second portion of paintballs move in a direction parallel to the receiver for replenishing paintballs from the second portion of paintballs to the first portion of paintballs, wherein a paintball is able to leave at least one colored mark upon breakage of the paintball.

2. The ammunition storage of claim 1, wherein the receiver contains a propelling mechanism for launching a paintball and the ammunition receiving port configured to receive paintballs.

3. The ammunition storage of claim 1, wherein the DCM includes at least one ammunition carrier which contains delivery capsules with fins.

4. The ammunition storage of claim 1, wherein the receiver includes a top surface, a bottom surface, a front side, and a back side, wherein the top surface faces sky, the bottom surface faces ground, the front side launches a paintball, and the back side faces a user, wherein the ammunition receiving port is situated at the bottom surface of the receiver.

5. The ammunition storage of claim 1, wherein the two canisters of the DCM include a left-side drum-shaped cylinder ("LDC") and a right-side drum-shaped cylinder ("RDC"), wherein LDC and RDC are bridged by a magazine base.

6. The ammunition storage of claim 5, wherein the ammunition supply port couples to the ammunition receiving port of receiver for channeling paintballs traveling from the canisters to the receiver via the magazine base and the magazine extender.

7. The ammunition storage of claim 1, wherein each canister of the DCM includes a round-shaped ammunition carrier able to rotate along its axis within the canister, wherein the ammunition carrier includes a range of six (6) to twenty (20) ammunition chambers.

8. The ammunition storage of claim 7, wherein each ammunition chamber includes a loading opening for paintball entrance and a dispensing opening for paintball departure, wherein each ammunition chamber is configured to hold a plurality of paintballs.

9. The ammunition storage of claim 1, wherein each canister of the DCM includes, a rotating agitator coupled to an ammunition carrier and capable of providing spinning motion for the ammunition carrier; and a pressure pedal coupled to ammunition chambers and having a plurality of pressing pads, wherein each of the plurality of pressing pads is configured to force the paintball moving from the loading opening to the dispensing opening.

10. The ammunition storage of claim 9, wherein each canister of the DCM further includes, a dispensing wheel situated adjacent to a dispensing end of the ammunition carrier and configured to dispense one projectile from dispensing openings of ammunition chambers in a predefined rate; and a ramp coupled to the dispensing wheel and configured to guide dispensed paintball from the ammunition carrier to the ammunition supply port.

11. A storage, comprising a dual cylindrical-shaped magazine ("DCM") containing an ammunition supply port situated between two canisters configured to facilitate ammunition moving in a direction against gravity to a receiver, wherein each canister of the DCM further includes, a rotating agitator coupled to an ammunition carrier and capable of providing spinning motion for the ammunition carrier; and a pressure pedal coupled to ammunition chambers and having a plurality of pressing pads, wherein each of the plurality of pressing pads is configured to force a projectile moving from a loading opening to a dispensing opening.

12. The storage of claim 11, wherein one of the two canisters of the DCM includes a dispensing wheel situated adjacent to dispensing end of the ammunition carrier and configured to dispense one projectile from dispensing openings of ammunition chambers in a predefined rate.

13. The storage of claim 12, wherein one of the two canisters of the DCM includes a ramp coupled to the dispensing wheel and configured to guide dispensed ammunition from the ammunition carrier to the ammunition supply port.

14. The storage of claim 11, wherein the DCM carries ammunition in such a way that a first portion of the ammunition moves toward a receiver against gravity for supplying projectiles from the ammunition supply port to an ammunition receiving port and a second portion of the ammunition move in a direction parallel to the receiver for replenishing ammunition from the second portion of the ammunition to the first portion of the ammunition.

15. The storage of claim 11, wherein the receiver includes a top surface, a bottom surface, a front side, and a back side, wherein the top surface faces sky, the bottom surface faces ground, the front side launches ammunition, and the back side faces a user, wherein an ammunition receiving port is situated at the bottom surface of the receiver.

16. The storage of claim 11, wherein the DCM is a bottom mounted ammunition magazine.

17. The storage of claim 11, wherein the receiver is a paintball receiver containing a striker, a valve, and a launch chamber configured to launch a paintball, and wherein the ammunition is a plurality of paintballs.

18. A method for supplying ammunition to a paintball launcher, comprising:

installing a first ammunition carrier having a plurality of ammunition chambers in a first canister of a dual-cylindrical magazine ("DCM") and a second ammunition carrier in a second canister of the DCM;

loading paintballs into loading openings of the plurality of ammunition chambers and setting a pressure pedal to guide the paintballs moving in a predefined direction;

engaging an ammunition supply port of the DCM with an ammunition receiving port in a paintball launcher; and releasing paintballs queued in a substantially vertical direction in a magazine extender through the ammunition supply port while portions of paintballs in the plurality of ammunition chambers move in a horizontal direction for replenishing released paintballs.

19. The method of claim 18, further comprising applying a pressure to the paintballs in the plurality of ammunition chambers by a follower and a spring.

20. The method of claim 19, further comprising leaving color marks upon breakage of a paintball upon hitting a target per QS.

* * * * *